US009903590B2

(12) United States Patent
Garry et al.

(10) Patent No.: US 9,903,590 B2
(45) Date of Patent: Feb. 27, 2018

(54) COMBUSTION CHAMBER

(71) Applicant: ROLLS-ROYCE PLC, London (GB)

(72) Inventors: Ian Murray Garry, Thurcaston (GB); Michael Lawrence Carlisle, Derby (GB)

(73) Assignee: ROLLS-ROYCE plc, London (GB)

( * ) Notice: Subject to any disclaimer, the term of this patent is extended or adjusted under 35 U.S.C. 154(b) by 547 days.

(21) Appl. No.: 14/559,320

(22) Filed: Dec. 3, 2014

(65) Prior Publication Data

US 2015/0176843 A1 Jun. 25, 2015

(30) Foreign Application Priority Data

Dec. 23, 2013 (GB) ..... 1322838.2

(51) Int. Cl.

| | |
|---|---|
| ***F23R 3/44*** | (2006.01) |
| ***F23M 5/04*** | (2006.01) |
| ***F23R 3/00*** | (2006.01) |
| ***F23R 3/06*** | (2006.01) |
| ***F23R 3/60*** | (2006.01) |

(52) U.S. Cl.

CPC ..... *F23R 3/44* (2013.01); *F23M 5/04* (2013.01); *F23R 3/002* (2013.01); *F23R 3/007* (2013.01); *F23R 3/06* (2013.01); *F23R 3/60* (2013.01); *F23R 2900/00017* (2013.01); *F23R 2900/00018* (2013.01)

(58) Field of Classification Search

CPC ..... F23R 3/60; F23R 3/44; F23R 3/06; F23R 3/007; F23R 3/002

See application file for complete search history.

(56) References Cited

U.S. PATENT DOCUMENTS

| | | | |
|---|---|---|---|
| 4,085,580 | A | 4/1978 | Slattery |
| 4,773,227 | A | 9/1988 | Chabis |
| 5,079,915 | A | 1/1992 | Veau |
| 5,363,643 | A | 11/1994 | Halila |
| 8,113,004 | B2 | 2/2012 | Carlisle et al. |

(Continued)

FOREIGN PATENT DOCUMENTS

| | | | |
|---|---|---|---|
| DE | 10 2004 044852 | A1 | 3/2006 |
| EP | 1 413 831 | A1 | 4/2004 |

(Continued)

OTHER PUBLICATIONS

Apr. 29, 2015 Search Report issued in European Patent Application No. 14 19 6026.

(Continued)

*Primary Examiner* — Craig Kim
(74) *Attorney, Agent, or Firm* — Oliff PLC

(57) ABSTRACT

A double wall structured combustor having an outer wall having an inner surface and an outer surface and an inner wall comprising a plurality of tiles. Each tile has at least one interlocking member at a first wall and at least one interengaging member at a second wall. The interlocking member extending through an aperture in the outer wall, and the interengaging member at the second wall engaging with a cutaway section in the first wall of an adjacent tile. On assembly of the combustion chamber, the interlocking members and interengaging members of the tiles ensure lower profile fixings and an overall reduction in number of conventional fasteners used.

18 Claims, 5 Drawing Sheets

(56) References Cited

U.S. PATENT DOCUMENTS

| | | | | |
|---|---|---|---|---|
| 2001/0029738 | A1 | 10/2001 | Pidcock et al. | |
| 2003/0145604 | A1 | 8/2003 | Pidcock et al. | |
| 2011/0030378 | A1 | 2/2011 | Carlisle | |
| 2015/0369490 | A1* | 12/2015 | Cunha | F23R 3/002 60/752 |

FOREIGN PATENT DOCUMENTS

| | | | |
|---|---|---|---|
| GB | 2 074 308 | A | 10/1981 |
| GB | 2 087 065 | A | 5/1982 |
| GB | 2 298 266 | A | 8/1996 |
| GB | 2 368 902 | A | 5/2002 |

OTHER PUBLICATIONS

Jun. 26, 2014 United Kingdom Search Report issued in Application No. GB1322838.2.

* cited by examiner

COMBUSTION CHAMBER

FIELD OF THE INVENTION

The present invention relates to a combustion chamber, and in particular to a combustion chamber for a gas turbine engine.

BACKGROUND TO THE INVENTION

Currently double walled combustors have an inner wall comprising a plurality of tiles. The tiles have studs that are integral with the tile for attachment to an outer wall. Conventional tiles have pedestals on their outer surfaces to provide cooling of the tiles.

Advances in gas turbine engine technology have resulted in an increase in temperature with increasing focus on emissions regulations, and consequently the pedestal cooling arrangement of the tiles may be superseded by an impingement effusion cooling arrangement of the tiles.

Tiles with an impingement effusion cooling arrangement have an array of effusion cooling holes arranged at a relatively low angle, typically twenty degrees, to the tile surface. Forming these holes at the angle required leads to manufacturing difficulties, due to the clash between a laser head and the protruding studs. As a consequence, the resulting tile either has a significant area around each stud that is devoid of effusion cooling holes, or alternative approach vectors have to be defined so that the laser head avoids clashing with the studs. The alternative approach requires extra programming time, extra manufacturing time, and leads to a compromise in the X and Y positioning of the effusion cooling holes on the tile surface, and the 'a, b, c angular definition of the hole vector'.

In some arrangements of non-pedestal tiles the studs which are an integral part of the tile, and which protrudes through the combustor outer wall, are replaced with alternative arrangements which are disclosed in U.S. Pat. No. 5,079,915 and U.S. Pat. No. 4,085,580. In both of these arrangements the tile is provided with a threaded receptacle into which a bolt is inserted through the outer wall. The end of the receptacle abuts the internal surface of the outer wall and helps define the depth of the air flow channel which has an optimum depth to maintain a desired flow speed. Additionally, where pedestals are provided, the receptacles ensuring the pedestals abut the inner surface of the outer wall to aid heat transfer away from the combustor tile.

The securing arrangements described in U.S. Pat. No. 5,079,915 and U.S. Pat. No. 4,085,580 require a minimum number of thread turns to securely mount the tile on the outer wall. This may lead to the depth of the air flow channel being too great for the pedestals to make contact or the flow area being too great, thereby reducing efficiency, as more air is required for cooling, and as a consequence less air is available for diluting the combustion.

It is an object of the present invention to provide an improved combustion chamber.

SUMMARY OF THE INVENTION

According to a first aspect of the present invention there is provided a combustor having a double wall structure comprising an annular inner wall and an annular outer wall, the annular outer wall having an inner surface, an outer surface and a plurality of circumferentially spaced apertures, the annular inner wall comprising a plurality of tiles, wherein the tiles have at least one interlocking member at a first circumferential end of the tile and at least one interengaging member at a second circumferential end of the tile, each interlocking member extending through a corresponding one of the circumferentially spaced apertures in the annular outer wall and resting on the outer surface of the annular outer wall, and the interengaging member at the second circumferential end of the tile engaging with the first circumferential end of an adjacent tile.

Optionally the at least one interlocking member extends radially from a first wall at the first circumferential end of the tile.

Preferably the first wall at the first circumferential end has at least one cutaway section to receive an interengaging member.

Preferably at least one interengaging member extends circumferentially from a second wall at the second circumferential end of the tile.

Preferably two interlocking members extend radially from the first wall at the first circumferential end of the tile, the first wall at the first circumferential end of the tile has two cutaway sections, and two interengaging members extending circumferentially from the second wall at the second circumferential end of the tile.

Optionally the tile further comprises at least one protrusion member located at a third wall of the tile.

The protrusion member may act as a positioning guide, wherein the protrusion member formed on the tile wall is mateably received in a corresponding blind aperture within the inner surface of the annular outer wall.

Optionally the annular outer wall further comprises at least one blind aperture extending into the inner surface to receive the protrusion member.

The blind aperture acts as a positioning guide, and may receive the corresponding protrusion member.

Preferably there is an interference fit between the protrusion member and the blind aperture.

The interference fit between the blind aperture within the inner surface of the annular outer wall and the protrusion member ensures that the tiles are aligned in both axial and circumferential planes with respect to the annular outer wall.

Preferably a combustor having a final tile, the final tile comprising at least one interlocking member at a first circumferential end of the final tile, or at least one interengaging member at a second circumferential end of the final tile.

Preferably the final tile comprising an integral stud formed at the first circumferential end or second circumferential end, the integral stud extending radially from the first circumferential end or second circumferential end.

The integral stud formed at the first circumferential end or at the second circumferential end extending through an aperture in the annular outer wall.

The at least one interlocking member may be L-shaped or any other suitable shape. the combustor may be an annular combustor, the annular outer wall being arranged around the annular inner wall, the at least one interlocking member extending radially outwardly through the corresponding one of the circumferentially spaced apertures in the annular outer wall.

The tile or final tile may be manufactured from a casting process.

Alternatively the tile or final tile may be manufactured from an additive layer manufacturing route.

Preferably the additive layer manufacturing route is direct laser deposition.

The combustor comprising a double wall structure may be a gas turbine engine combustor.

According to a second aspect of the present invention there is provided a combustor tile comprising a curved surface, the curved surface bounded by walls, the combustor tile comprising at least one L-shaped interlocking member at a first end of the tile, and at least one interengaging member at a second end of the tile, wherein the interengaging member extends away from the first end and the second end, and the L-shaped interlocking member extends away from the curved surface and away from the first end and the second end.

BRIEF DESCRIPTION OF THE DRAWINGS

The present invention will be more fully described by way of example with reference to the accompanying drawings in which:—

DETAILED DESCRIPTION OF THE INVENTION

Figure 1:
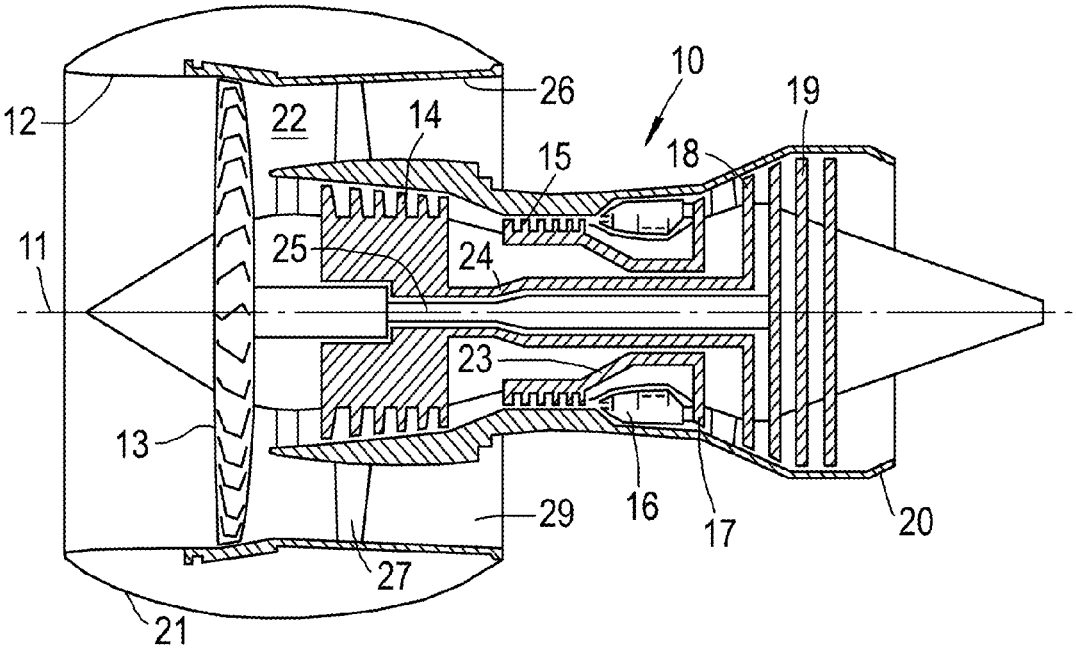
FIG. 1 shows a turbofan gas turbine engine having a combustor.

With reference to FIG. 1, a ducted fan gas turbine engine generally indicated at 10 has a principal and rotational axis 11. The ducted fan gas turbine engine 10 comprises, in axial flow series, an air intake 12, a propulsive fan 13, an intermediate pressure compressor 14, a high pressure compressor 15, combustion equipment 16, a high pressure turbine 17, an intermediate pressure turbine 18, a low pressure turbine 19 and a core exhaust nozzle 20. A nacelle 21 generally surrounds the engine 10 and defines the intake 12 and a bypass exhaust nozzle 29.

The ducted gas turbine engine 10 works in the conventional manner so that air entering the intake 11 is accelerated by the fan 13 to produce two air flows: a first air flow into the intermediate pressure compressor 14 and a second air flow which passes through a bypass duct 22 and out of the bypass exhaust nozzle 29 to provide propulsive thrust. The intermediate pressure compressor 14 compresses the air flow directed into it before delivering that air to the high pressure compressor 15 where further compression takes place.

The compressed air exhausted from the high pressure compressor 15 is directed into the combustion equipment 16 where it is mixed with fuel and the mixture combusted. The resultant hot combustion products then expand through, and thereby drive the high, intermediate and low pressure turbines 17, 18, 19 before being exhausted through the core exhaust nozzle 20 to provide additional propulsive thrust. The high, intermediate and low pressure turbines 17, 18, 19 respectively drive the high and intermediate pressure compressors 15, 14 and the fan 13 by suitable interconnecting shafts 23, 24 and 25 respectively. The fan 13 is circumferentially surrounded by a structural member in the form of a fan casing 26, which is supported by an annular array of outlet guide vanes 27.

Figure 2:
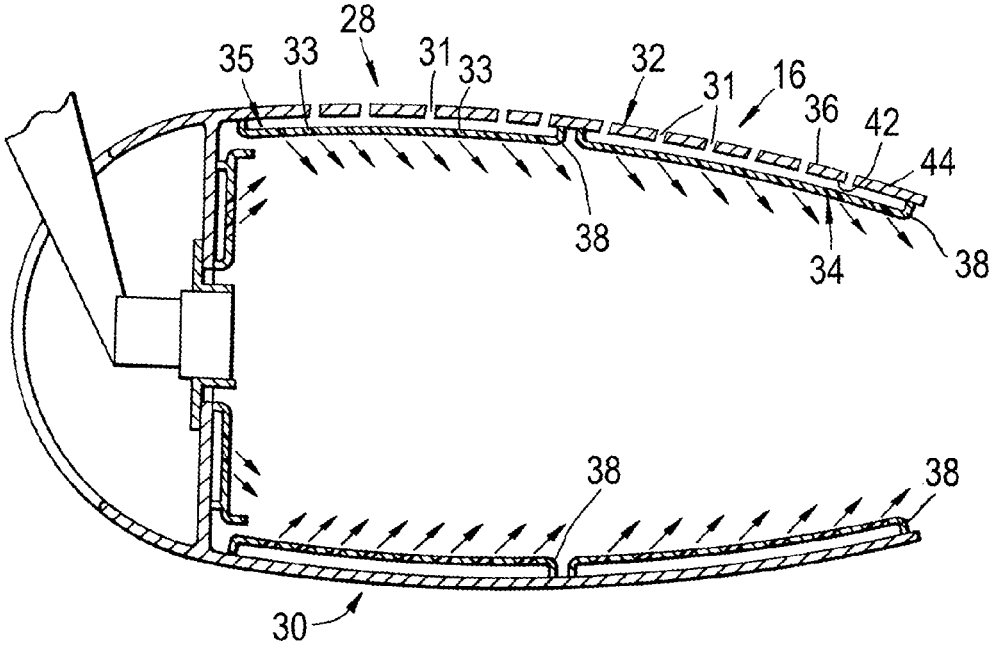
FIG. 2 shows a cross section of an annular combustor.

The combustion equipment 16 includes an annular combustor 28 having radially inner and outer wall structures 30 and 32 respectively, as shown in FIG. 2. Fuel is directed into the annular combustor 28 through a number of fuel nozzles located at the upstream end of the annular combustor 28. The fuel nozzles are circumferentially spaced around the engine 10 and serve to spray fuel into the air supplied from the high pressure compressor 15. The fuel is then combusted in the air in the annular combustor 28.

Referring to FIG. 2, the radially outer wall structure 32 comprises an inner wall 34 and an annular outer wall 36. The inner wall 34 comprises a plurality of tiles 38 each of which has substantially the same rectangular configuration, and the tiles 38 are positioned adjacent to each other. The tiles 38 are arranged in axially adjacent rows and each row comprises circumferentially adjacent tiles 38. The tiles 38 are arranged such that the downstream edge of each tile 38 in a row is in the same plane as an adjacent tile 38. The outer wall 36 has a plurality of impingement holes 31, and coolant (air) delivered from the high pressure compressor 15 enters the impingement holes 31 and is directed onto an outer surface 35 of each tile 38. The coolant flows over the outer surfaces 35 of the tiles 38 and then passes through the effusion cooling holes 33 formed through the tiles 38, thereby providing a cooling film over an inner surface 34 of each tile 38.

Figure 3:
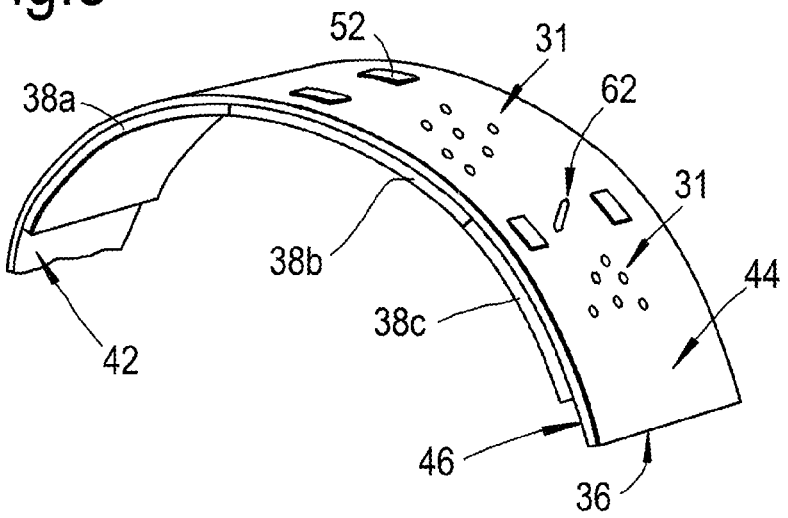
FIG. 3 shows a perspective view of a part assembled outer wall structure of an annular combustor.

A part assembled radially outer wall structure 32 of the annular combustor 28 is shown in a perspective view in FIG. 3. The annular outer wall 36 having an inner surface 42 and an outer surface 44. The annular inner wall 34 comprises a plurality of tiles 38 as mentioned previously. FIG. 3 shows part of the overall assembly, only showing three tiles 38*a*, 38*b* and 38*c* of the annular inner wall 34 mounted on the annular outer wall 36. The tiles 38*a*, 38*b* and 38*c* are mounted on the annular outer wall 36 by providing apertures through the annular outer wall 36, and introducing interlocking members 52, that are provided at one tile end, through the corresponding apertures. The detail of the present invention and the method of assembly will now be described.

Figure 4:
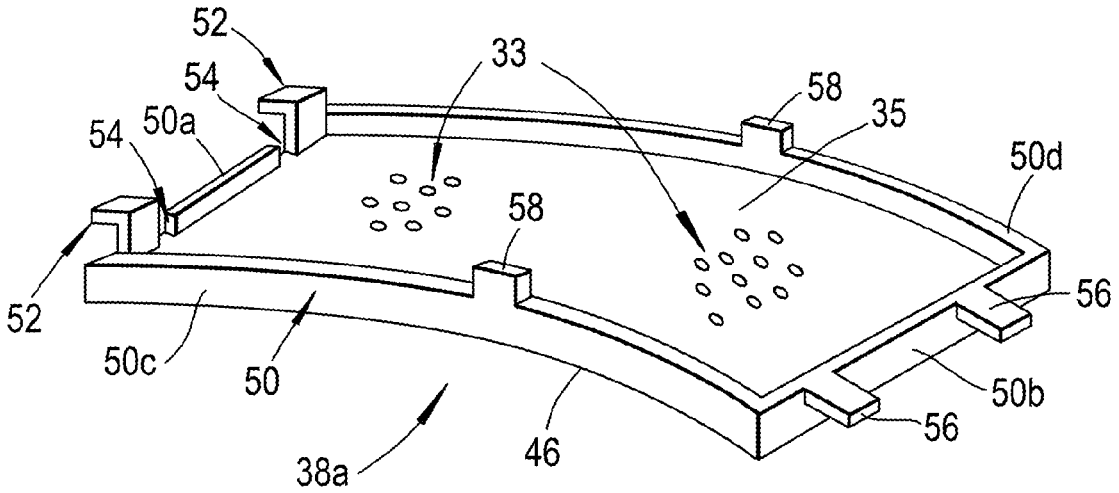
FIG. 4 shows a perspective view of a combustor tile.

A tile 38*a* is shown in a perspective view in FIG. 4. The tile 38*a*, comprising a substantially rectangular shape and having a curved outer surface 35. The curved outer surface 35 is bounded by mainly perpendicular walls 50 extending from the curved outer surface 35. Each tile 38*a* having two walls 50*a* and 50*b* which extend radially outwards at first and second circumferentially spaced ends. The tile 38*a* having two further walls 50*c* and 50*d* which extend radially outwards at first and second axial edges, and thus the walls 50*a*, 50*b*, 50*c* and 50*d* fully bound the curved surface 35 of the tile 38*a*.

Two interlocking members, or hooks, 52 extend radially and circumferentially from the first wall 50*a* at the first end of the tile 38*a*. The interlocking members 52 may be L-shaped or any other suitable shape. In this arrangement the two interlocking members 52 are positioned on the first wall 50*a* near to the walls 50*c* and 50*d* at the first and second axially spaced edges. Each interlocking member 52 is positioned at the same distance from the centre of the first wall

50*a*. The first wall 50*a* has two cutaway sections 54 formed and located adjacent to and inwards from the interlocking members 52. In summary, the interlocking members 52 and cutaway sections 54 are arranged symmetrically on the first wall 50*a*, whereby from the midpoint of the first wall 50*a*, there is a cutaway section 54 and then an interlocking member 52. The interlocking members 52 are an integral part of the first wall 50*a* of the tile 38*a*, and are formed during the tile manufacturing process.

Two interengaging members, or tabs, 56 are provided on the tile 38*a* at the second wall 50*b*. The interengaging members 56 extend circumferentially from the external surface of the second wall 50*b* of the tile 38*a*. FIG. 4 shows two interengaging members 56 which are positioned away from the middle of the second wall 50*b*. The two interengaging members 56 at the second wall 50*b* of the tile 38*a* are in a spaced relationship with the two cutaway sections 54 formed at the opposing first wall 50*a* of the tile 38*a*. The interengaging members 56 at the second wall 50*b* of the tile 38*a* are thus aligned with the corresponding cutaway sections 54 formed at the first wall 50*a*. The interengaging members 56 are an integral part of the tile 38*a*, and are formed during the tile manufacturing process.

Protrusions, or lugs, 58 are provided on each of the third and fourth walls 50*c* and 50*d* respectively. The protrusions 58 extend radially outwards from the third and fourth walls 50*c* and 50*d*. The protrusions 58 are aligned longitudinally, circumferentially, with each other as shown in FIG. 4. Alternatively the protrusions may be located in different longitudinal, circumferential, positions on the third and fourth walls 50*c* and 50*d*. If the protrusions 58 are in an aligned relationship, then there is symmetry about the longitudinal axis of the tile 38*a*.

Figure 5:
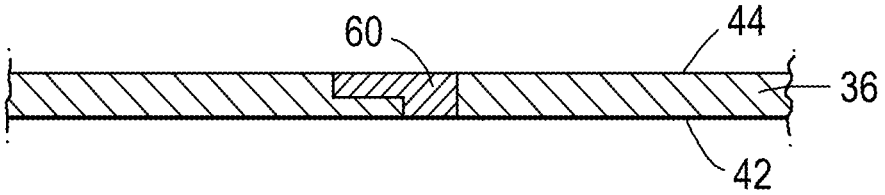
FIG. 5 shows a cross sectional view of an outer wall of the outer wall structure.

The annular outer wall 36 has a series of apertures 60 that extend from the inner surface 42 to the outer surface 44. Each aperture 60 having dimensions arranged to receive an associated interlocking member 52, and is shown in cross section in FIG. 5. Each aperture 60 may have a tapered cross section, a chamfered or angled cross section, thus making it easier for the interlocking member 52 of the tile 38*a* to be manipulated and introduced into the aperture 60. The exact positioning of the apertures 60 on the outer wall 36 is dependent on the corresponding positioning of the interlocking members 52 on the tiles 38*a*.

Figure 12:
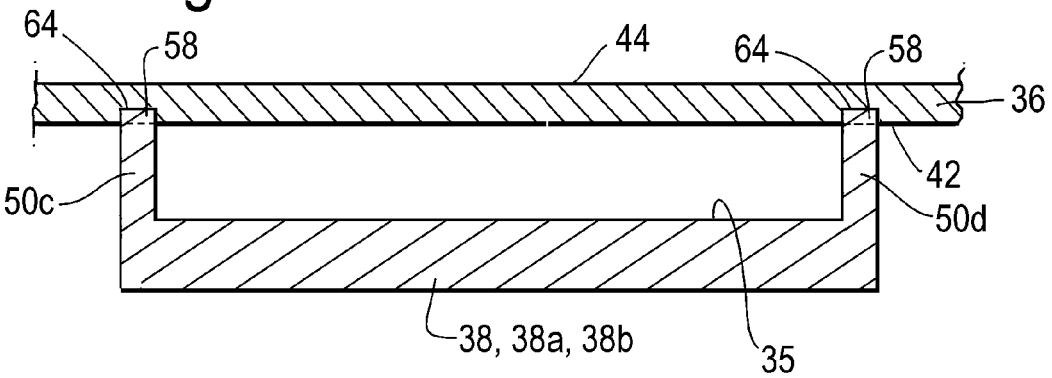
FIG. 12 shows a cross-sectional view of the outer wall structure.

Additionally the annular outer wall 36 has a number of blind apertures 64, as shown in FIG. 12, extending radially into the inner surface 42. During assembly of the tiles 38 onto the annular outer wall 36, an interference fit is created between the protrusions 58 on the tiles 38 and the blind apertures 64 formed in the inner surface 42 of the annular outer wall 36. This interference fit, or push fit, ensures that the tiles 38 are aligned in both axial and circumferential planes.

Figure 6:
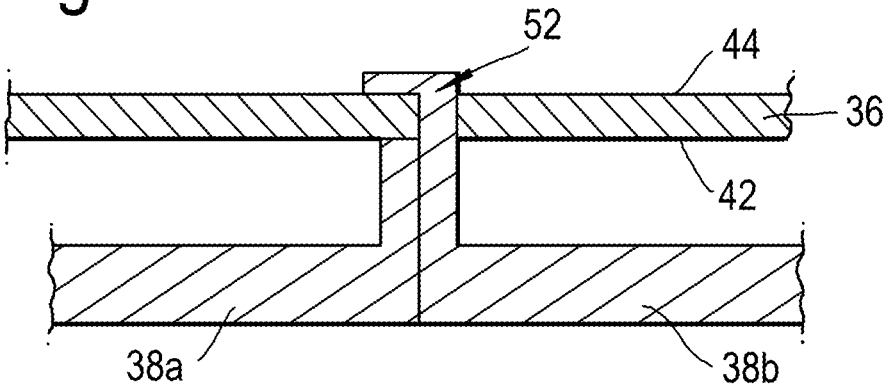
FIG. 6 shows a cross sectional view of the outer wall structure.
Figure 7:
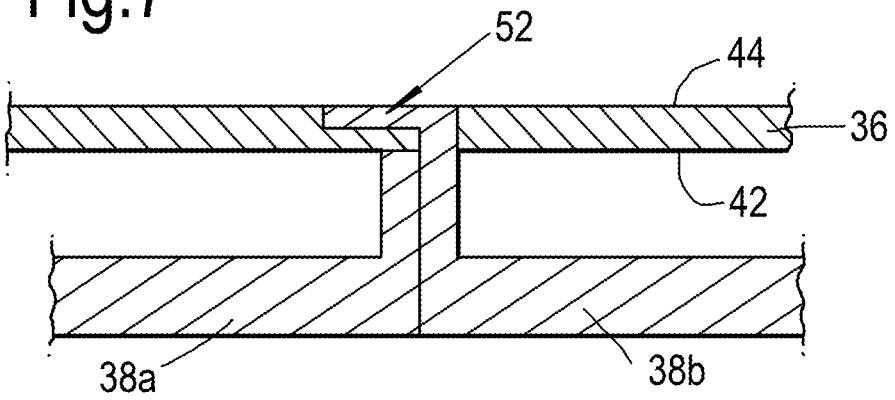
FIG. 7 shows an alternative cross sectional view of the outer wall structure.

The next stage is to assemble each tile 38 into the annular outer wall 36, thus forming the outer wall structure 30 of the annular combustor 28. Each tile 38, configured as 38*a* and shown in FIG. 4 is held, and the interlocking members 52 at the first wall 50*a* are aligned with the corresponding apertures 60 within the annular outer wall 36. The circumferentially extending portion and then the radially extending portion of the interlocking members 52 are manipulated through the corresponding apertures 60 within the annular outer wall 36. The circumferentially extending portion of the interlocking members 52 are seated against the outer surface 44 of the annular outer wall 36 as shown in FIG. 6. In an alternative arrangement, once the interlocking members 52 are manipulated through the apertures 60 within the annular outer wall 36, the circumferentially extending portions of the interlocking members 52 are seated within corresponding recesses and are flush with the outer surface 44 of the annular outer wall 36 as shown in FIG. 7.

The assembly of the adjacent tile 38*b* may now begin, building up the tiles 38 into an annular array of tiles 38 within the annular outer wall 36. The previously partially fitted tile 38*a*, with its first wall 50*a* mounted onto the annular outer wall 36 has its second wall 50*b* freely hanging. An adjacent tile 38*b* is held, and the interlocking members 52 at the first wall 50*a* are aligned with the corresponding apertures 60 within the annular outer wall 36. The circumferentially extending portion and then the radially extending portion of the interlocking members 52 are manipulated through the corresponding apertures 60 within the annular outer wall 36, and the second wall 50*b* of the adjacent tile is again freely hanging. The circumferentially extending portions of the interlocking members 52 of the adjacent tile 38 are assembled to be seated against the outer surface 44 of the annular outer wall 36, or seated in a recess in the outer surface 44 of the annular outer wall 36, similarly to the previously fitted tile 38*a*.

The next part of the assembly is to mateably receive the interengaging members 56 of the previously part fitted tile 38*a* into the corresponding cutaway sections 54 of the adjacent tile 38*b*. The freely hanging wall 50*b* of the previous tile 38*a* is raised by applying a small force from the tile base 46, and manipulating the interengaging members 56 of the tile 38*a* into the corresponding cutaway sections 54 in the adjacent tile 38*b*, as shown in FIG. 8.

The next stage of the assembly ensures that the longitudinal axis (corresponding with the circumferential orientation of the combustor 16 and gas turbine engine 10) and the lateral axis (corresponding to the axis of the combustor 16, and gas turbine engine 10) of the tile 38*a* is aligned to the circumferential and axial direction of the annular outer wall 36. The tile 38 is pressed from the base 46 to apply a radial outward force to fixedly engage the protrusion members 58 in their respective blind apertures 64 in the annular outer wall 36.

Figure 8:
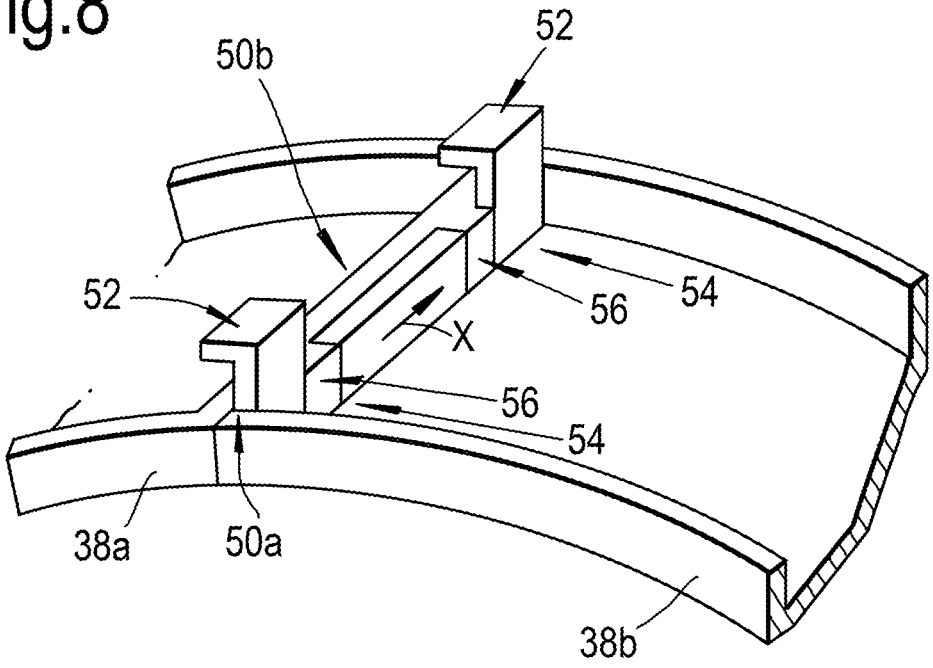
FIG. 8 shows a perspective view of the assembled combustor tiles.
Figure 9:
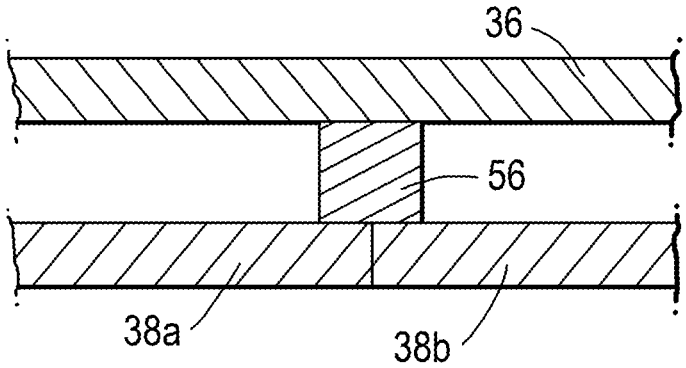
FIG. 9 shows a cross sectional view taken through side elevation of the outer wall structure.

FIG. 9 shows a cross section taken in direction X as shown in FIG. 8, through the side elevation of the assembled tiles 38*a* and 38*b* and shows the interengaging members 56 and the annular outer wall 36. The above sequence is repeated until the final combustor tile needs to be positioned and assembled within the annular outer wall 36.

Figure 10:
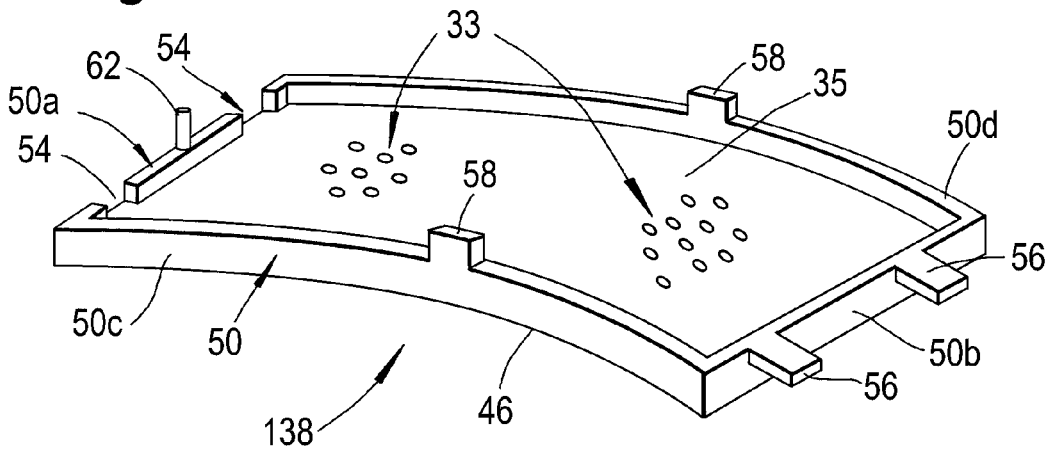
FIG. 10 shows a perspective view of a final combustor tile.
Figure 11:
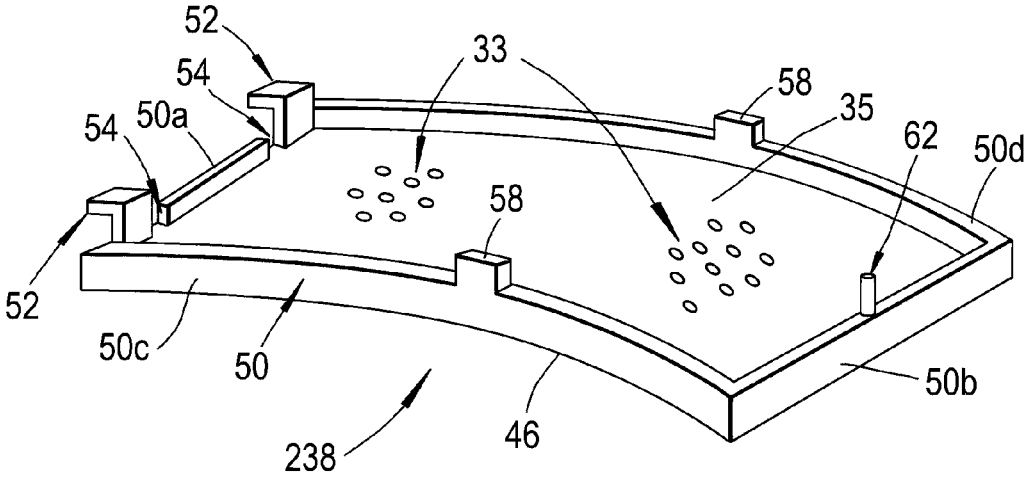
FIG. 11 shows a perspective view an alternative final combustor tile.

The final tile 38 is generally the same as tile 38*a*, and differs in the following respects. A first final combustor tile 138 is shown in FIG. 10. The tile 138 does not have interlocking members located at a first wall 50*a*. A radially extending stud 62 extends from the first wall 50*a* and is integrally formed during the manufacturing of the tile 138. An alternative final tile 238 is shown in FIG. 11. The tile 238 does not have interengaging members extending circumferentially from the second wall 50*b*. Instead a radially extending stud 62 extends from the second wall 50*b*, and again is integrally formed during the manufacture of tile 238. A corresponding aperture through the annular outer wall 36 is made to receive the stud 62 for fastening the tile 138 or 238, to the annular outer wall 36.

The method of assembling final tile 138, or 238, will be described individually. Firstly considering tile 138 as shown in FIG. 10, the interengaging members 56 locate into cutaway sections 54 of the adjacent tile 38*a*. The protrusion members 58 fixedly engage into respective blind apertures 64 within the inner surface 42 of the annular outer wall 36. The tile 138 is pressed from a first wall 50*a* from the base 46, so that the integral stud 62 is mateably received into the corresponding aperture made in the annular outer wall 36, and the interengaging members 56 of the previous tile 38 locate in the cutaway sections 54 on the tile 138. A fastening nut is fitted onto the protruding portion of the integral stud 62 to secure the tile 138 onto the annular outer wall 36, thus completing the assembly of the radially outer wall structure 30.

Alternatively, tile 238 may be used as the last tile to be assembled, as shown in FIG. 11. The interlocking members 52 are manipulated through the corresponding apertures 60 within the annular outer wall 36 in the same manner of assembly as the normal tiles 38, as shown in FIGS. 6 and 7. The interengaging members 56 of the previous tile 38 locate in the cutaway sections 54 on the tile 238. Similarly, the protrusions 58 are received into respective blind apertures within the inner surface 42 of the annular outer wall 36. The tile 238 is pressed from a second wall **50*b* from the base 46, so that the integral stud 62 is mateably received into a corresponding aperture made in the annular outer wall 36. A fastening nut is fitted to the protruding portion of the integral stud 62 to secure the tile 238 onto the annular outer wall 36**, thus completing the assembly.

The tiles 38 described may be manufactured from a number of manufacturing routes. The tiles 38 may be manufactured using an additive layer manufacturing route, e.g. using a direct laser deposition technique. Equally the tiles 38 may be manufactured using a casting process. It is to be noted that the interlocking members 52 and the interengaging members 56 are integral with the tile, e.g. the interlocking members 52, the interengaging members 56 and the tile 38 are one piece structures.

Other examples of tiles may have three interlocking members extending radially from the first wall at the first ends of the tiles, with the third interlocking member at the centre of the first wall, two cutaway sections in the first walls, and two interengaging members on the second walls of the tiles.

Further examples of tiles may have one interlocking member extending radially from the centre of the first walls at the first ends of the tiles, two cutaway sections in the first walls, and two interengaging members on the second walls of the tiles.

Additional examples of tiles may have two interlocking members extending radially from the first wall at the first ends of the tiles, one cutaway section in the centre of the first walls, and one interengaging member in the centre of the second walls of the tiles.

Although the present invention has been described with reference to the interlocking member, or interlocking members, extending radially from the first wall at the first end of the tile, it may be possible for the interlocking member, or interlocking members, to extend directly, radially from the outer surface of the tile at or adjacent the first end of the tile, and may be spaced from the first wall at the first end of the tile.

A number of advantages result from the present invention and are briefly discussed below. The number of fasteners required to assemble the tiles onto the annular outer wall is significantly reduced. Due to the reduction in the number of fasteners, there is a potential cost reduction and weight reduction. The reduction in the number of fasteners provides an assembly method which has almost eliminated the use of conventional bolt and or stud and nut type fasteners, and this may lead to a reduction in the overall assembly time. Additionally, the use of the interlocking members and interengaging members ensures that the high profile conventional fastener fixings are replaced by much lower profile fixings. The lower profile fixings provided by the present invention leads to minimal interference during further processing of the unassembled tile, and in particular makes it easier for a laser or similar tooling to produce low angle effusion cooling holes within the tiles. The effusion cooling holes may be produced in the desired position and with the required orientation. Finally, the assembly fixings are provided at the periphery of the tile, e.g. at a less intrusive position.

It will be understood that the invention has been described in relation to its preferred embodiments and may be modified in many different ways without departing from the scope of the invention as defined by the accompanying claims. The features of the embodiment may be interchangeable. The shape and design of the interlocking members, the interengaging members may be changed, and many different configurations are possible without moving away from the inventive concept. The shapes used within these embodiments are provided as one example. Where two interlocking members, two interengaging members or two protrusions are described, it may equally be assembled with at least one of these features. The arrangement of the double walled combustor structure is shown as an annular arrangement. The arrangement and assembly is not restricted to merely an annular combustor, and the approach of using interlocking members, interengaging members and cutaway sections to fasten a tile to a combustor wall is not restricted to a gas turbine engine combustor.

The invention claimed is:

1. A combustor having a double wall structure comprising:

an annular inner wall and an annular outer wall, the annular outer wall having an inner surface, an outer surface, and a plurality of circumferentially spaced apertures, the annular outer wall including at least one blind aperture extending into the inner surface, and the annular inner wall comprising a plurality of circumferentially arranged tiles, the tiles having at least one interlocking member at a first circumferential end of each tile, at least one interengaging member at a second circumferential end of each tile, and at least one protrusion member extending from a wall of each tile, each interlocking member extending through a corresponding one of the circumferentially spaced apertures in the annular outer wall and resting on the outer surface of the annular outer wall, the interengaging member at the second circumferential end of each tile engaging with the first circumferential end of an adjacent tile, and each protrusion member extending into a corresponding blind aperture.

2. The combustor according to claim 1, wherein there is an interference fit between the protrusion member and the blind aperture.

3. A combustor having a double wall structure comprising:

an annular inner wall and an annular outer wall, the annular outer wall having an inner surface, an outer surface, and a plurality of circumferentially spaced apertures, the annular inner wall comprising a plurality of circumferentially arranged tiles, the tiles having at least one interlocking member at a first circumferential end of each tile and at least one interengaging member at a second circumferential end of each tile, the interengaging member at the second circumferential end of each tile engaging with the first circumferential end of an adjacent tile, wherein the annular outer wall and the annular inner wall interact together such that:

each interlocking member extends through a corresponding one of the circumferentially spaced apertures in the annular outer wall and rests on the outer surface of the annular outer wall, and each interengaging member extends radially inward of the outer surface of the annular outer wall.

4. The combustor according to claim 3, further including a final tile, the final tile comprising at least one interlocking member at a first circumferential end of the final tile or at least one interengaging member at a second circumferential end of the final tile.

5. The combustor according to claim 3, wherein the at least one interlocking member extends radially from a first wall at the first circumferential end of each tile.

6. The combustor according to claim 5, wherein the first wall at the first circumferential end has at least one cutaway section to receive an interengaging member.

7. The combustor according to claim 3, wherein the at least one interengaging member extends circumferentially from a second wall at the second circumferential end of each tile.

8. The combustor according to claim 3, wherein:

two interlocking members extend radially from a first wall at the first circumferential end of each tile, the first wall at the first circumferential end of each tile has two cutaway sections, and two interengaging members extend circumferentially from a second wall at the second circumferential end of each tile.

9. The combustor according to claim 1, wherein the at least one protrusion member is located on a third wall of each tile.

10. The combustor according to claim 4, wherein the final tile comprises an integral stud formed at the first circumferential end or second circumferential end, the integral stud extending radially from the first circumferential end or second circumferential end.

11. The combustor according to claim 3, wherein the at least one interlocking member is L-shaped.

12. The combustor according to claim 3, wherein the combustor is an annular combustor, the annular outer wall being arranged around the annular inner wall, the at least one interlocking member extending radially outwardly through the corresponding one of the circumferentially spaced apertures in the annular outer wall.

13. The combustor according to claim 3, wherein the plurality of circumferentially arranged tiles are manufactured from an additive layer manufacturing route.

14. The combustor according to claim 13, wherein the additive layer manufacturing route is direct laser deposition.

15. The combustor according to claim 3, wherein the plurality of circumferentially arranged tiles are manufactured from a casting process.

16. A gas turbine engine comprising a combustor, wherein the combustor comprises a double wall structure according claim 3.

17. A combustor having a double wall structure comprising:

an annular inner wall and an annular outer wall, the annular outer wall having an inner surface, an outer surface, and a plurality of circumferentially spaced apertures, the annular inner wall comprising a plurality of circumferentially arranged tiles, each tile having an outer surface, a first wall at a first circumferential end of each tile, a second wall at a second circumferential end of each tile, a third wall at a first axial edge of each tile, and a fourth wall at a second axial edge of each tile, the first wall, the second wall, the third wall, and the fourth wall extending radially outwards from the outer surface of each tile towards the inner surface of the annular outer wall, each tile having at least one interlocking member at the first circumferential end of each tile and at least one interengaging member at the second circumferential end of each tile, each interlocking member extending through a corresponding one of the circumferentially spaced apertures in the annular outer wall, each interlocking member extending radially and circumferentially from the first circumferential end of each tile, the interlocking member comprising a radially extending portion and a circumferentially extending portion, and the circumferentially extending portion resting on the outer surface of the annular outer wall, the interengaging member extending circumferentially from the second wall at the second circumferential end of each tile, each interengaging member being located radially between the inner surface of the annular outer wall and the outer surface of the adjacent tile, the first wall at the first circumferential end of the tile having at least one cutaway section, and the interengaging member at the second circumferential end of each tile engaging with the at least one cutaway section in the first wall at the first circumferential end of an adjacent tile.

18. The combustor according to claim 17, wherein the first wall, the second wall, the third wall, and the fourth wall extend radially outwards from the outer surface of the tile and abut the inner surface of the annular outer wall.

* * * * *